US006241018B1

(12) United States Patent
Eriksen

(10) Patent No.: US 6,241,018 B1
(45) Date of Patent: Jun. 5, 2001

(54) HYDRAULIC RUNNING TOOL

(75) Inventor: Erik Peter Eriksen, Katy, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 09/348,908

(22) Filed: Jul. 7, 1999

(51) Int. Cl.[7] ..... E21B 23/01
(52) U.S. Cl. ..... 166/215; 166/217
(58) Field of Search ..... 166/118, 134, 166/136, 208, 212, 215, 217

(56) References Cited

U.S. PATENT DOCUMENTS

| | | | | |
|---|---|---|---|---|
| 3,094,337 | | 6/1963 | Pippert et al. . | |
| 4,043,390 | * | 8/1977 | Glotin | 166/215 |
| 4,440,233 | | 4/1984 | Baugh et al. | 166/382 |
| 4,441,560 | | 4/1984 | Baugh et al. . | |
| 4,489,781 | | 12/1984 | Weeks | 166/208 |
| 4,598,774 | | 7/1986 | Nevels et al. . | |
| 4,712,615 | | 12/1987 | Docking, Jr. et al. . | |
| 4,911,237 | * | 3/1990 | Melenyzer | 166/208 |
| 5,048,606 | | 9/1991 | Allwin . | |
| 5,538,082 | * | 7/1996 | Zwart | 166/382 |
| 5,551,512 | * | 9/1996 | Smith | 166/212 |
| 5,553,672 | * | 9/1996 | Smith, Jr. et al. | 166/382 |
| 6,065,536 | * | 5/2000 | Gudmestad et al. | 166/208 |

OTHER PUBLICATIONS

Collection of Product Description Documents (TIW Catalog 76–77).

* cited by examiner

*Primary Examiner*—Frank Tsay
(74) *Attorney, Agent, or Firm*—Thomason, Moser & Patterson, L.L.P.

(57) ABSTRACT

The present invention generally provides a running tool which can be released using hydraulic pressure and can provide continued rotation to a liner hanger or other tool disposed below and rotationally connected to the running tool. In one aspect, a hydraulic assembly is provided to release a thrusting cap from rotation so that a threaded connection between the running tool and the liner hanger can be released. On release of the liner hanger, a lock nut travels down a threaded surface of the thrusting cap and engages the thrusting cap to continue rotation through the thrusting cap. Additionally, the running tool may include a mechanical release operable without the assistance of hydraulic pressure.

36 Claims, 15 Drawing Sheets

HYDRAULIC RUNNING TOOL

BACKGROUND OF THE INVENTION

1. Field of the Invention

The present invention relates generally to oil well running tools. More specifically, the invention relates to a running tool adapted to engage a setting sleeve on a drill pipe or tubing string in a well bore, and specifically to a running tool which allows right hand rotation to be used during well bore operations and to release the setting tool from the setting sleeve.

2. Background of the Invention

Running tools are used for various purposes during well drilling and completion operations. For example, a running tool is typically used to set a liner hanger in a well bore. The running tool is made up in the drill pipe or tubing string between the liner hanger and the drill pipe or tubing string running to the surface. The running tool serves as a link to transmit torque to the liner hanger to place and secure the liner in the well bore. The running tool is then typically manipulated from the surface to effect release of the running tool from the liner hanger. The liner may then optionally be cemented into place in the well bore.

In a typical drill pipe or tubing string, lengths of drill pipe or tubing are connected by tool joints using right hand threads on the drill pipe. These joints are made up using right hand torque and unscrewed or released using left hand torque. Drilling is carried out by right hand or clockwise rotation of the drill string to avoid breaking out or loosening the tool joints making up the pipe string.

In one prior running tool design, connecting threads have been used to engage the running tool with the setting sleeve. In these designs, the running tool is releasable by right hand torque on the pipe string from the surface. However, this design requires holding or maintaining left hand torque on the pipe string while running into the well bore. These designs also require that the liner be set to the left in order to avoid releasing the running tool connecting threads. Because left hand torque is used to set the liner, the possibility exists that tool joints in the drill string can be unscrewed and a joint broken out.

In another prior running tool design, right hand rotation is used to both engage the liner hanger with the running tool and release the running tool from the liner hanger. FIGS. 1*a* and 1*b* are sectional views of a prior running tool design shown in a running-in position. The running tool 10 includes a mandrel body 12 having a threaded float nut 70 disposed on its lower end to engage a liner hanger. The running tool also includes a thrusting cap 58 having one or more latch keys 64 disposed thereon which are adapted to engage slots formed on the upper end of the liner hanger. The thrusting cap 58 is selectively engageable to the mandrel body 12 through a hydraulic assembly and a clutch assembly 19 which is engaged in the run-in position. Weight down is defined as the weight of the drill string supported on the running tool and liner hanger. The hydraulic assembly can be actuated to release the thrusting cap 58 from rotational connection with the mandrel body 12 to allow the threaded float nut 70 to be backed out of the liner hanger. The clutch assembly 19 is disengaged when the tool is in the weight down position. A torque nut 82 moves down a threaded surface of the thrusting cap 58 to re-engage the thrusting cap 58 and transmit torque imparted by the mandrel body 12 from the drill string to the thrusting cap 58.

One problem with this design is that the running tool can only be released from the liner hanger in a weight down position. The weight of the drill string causes the clutch assembly, e.g., the torque lock, to disengage from the key 78, thereby allowing relative rotation between the thrusting cap 58 and the float nut 70. This design is therefore limiting in its operation.

Therefore, there exists a need for a running tool which is releasable using right hand torque in any position such as weight down position, neutral position, or weight up position.

SUMMARY OF THE INVENTION

The present invention is directed to a running tool for setting a liner or other tool down hole. The running tool comprises a mandrel body, a latch assembly operably associated with the mandrel body, and a float nut carried on the mandrel body. In one aspect, the latch assembly comprises one or more dogs housed in a lock sleeve between an outer sleeve and the mandrel body and releasable under hydraulic pressure. The applied hydraulic force provides relative movement between the outer sleeve and the mandrel body, thereby releasing the dogs. A seal sub is disposed between the outer sleeve and the mandrel body and is connected to the mandrel body. The seal sub defines a fluid chamber in combination with the outer sleeve and the mandrel body. A thrusting cap connected to the lock sleeve includes one or more latch keys for engaging a setting sleeve and has a lock nut threadedly carried thereon in a passageway formed between the thrusting cap and the mandrel body, In another aspect, the invention provides an apparatus sized and adapted for setting a liner in a well bore. The apparatus comprises a mandrel body having an upper end adapted to be connected in a pipe string and a lower end; a float nut carried on the mandrel body, the float nut having external connecting threads for engaging mating threads located on a setting sleeve; and a latch assembly operably associated with the mandrel body and having a locking member to selectively transmit relative movement between a portion of the latch assembly and the mandrel body after the latch assembly has been disengaged from the mandrel body. The latch assembly is selectively connected to the mandrel body through one or more dogs and preferably comprises a hydraulically operated lock sleeve assembly to release the dogs.

In another aspect, the invention provides a running tool for use in rotating a liner hanger prior to and subsequent to setting of a liner hanger. The running tool includes a mandrel body having an upper end adapted to connect to a pipe string and a lower end adapted to connect a liner hanger; a threaded member connected to the mandrel body and adapted to connect the mandrel body to a liner hanger; and a latch key member disposed on the mandrel body selectively engageable to the mandrel body through a latch assembly and a lock assembly carried on the mandrel body. The latch assembly comprises a seal sub connected to the mandrel body; an outer sleeve disposed at least partially about the seal sub, the outer sleeve being selectively connected to the seal sub by a shear member, the seal sub, outer sleeve and mandrel body defining a chamber therebetween; and a lock sleeve rotatably locked to the mandrel body by one or more dogs disposed through the lock sleeve between the outer sleeve and the mandrel body, the lock sleeve being connected at its lower end to the thrusting cap. One or more ports connect the chamber to a bore in the mandrel body to enable fluid to flow through the mandrel body and into the chamber. The lock assembly comprises a lock nut threadedly connected to the thrusting cap and rotatably locked to the mandrel body by one or more splines.

In another aspect, a running tool for use in rotating a liner hanger prior to and subsequent to setting of the liner hanger in a well bore is provided. The running tool comprises a body defining a bore at least partially therethrough, the body having an upper internal threaded portion for connecting the body to a pipe string, an externally threaded member for connecting to a setting sleeve, a torque transmitting member to transmit torque from the body to a setting sleeve, the torque transmitting member being selectively rotatably locked or otherwise connected to the body by a latch assembly, the latch assembly comprising a lock sleeve rotatably locked or otherwise connected to the body by one or more dogs disposed at least partially therethrough and retained between the body; an outer sleeve, the dogs being releasable on movement of the outer sleeve relative to the lock sleeve; and a lock member rotatably locked or otherwise connected to the body and threadedly connected to the torque transmitting member, wherein the lock member is disposed in a passageway formed at least partially between the body and the torque transmitting member. The lock assembly further comprises a seal sub rotatably and sealably connected to the body and sealably disposed between the outer sleeve and the body; the seal sub, outer sleeve and body forming a fluid chamber therebetween having fluid communication to the bore in the body through one or more ports. The torque transmitting member is connected to the lock sleeve and the lock member.

In another aspect, a mechanical release is provided to enable operation of the tool without the assistance of hydraulic pressure. In this embodiment, a retaining sleeve is provided which is connected to the mandrel body through one or more shear pins. The retaining sleeve defines one or more recesses which house one or more dogs to prevent relative movement between the mandrel body and a locking sleeve. In a weight down position, the shear pins can be severed to disengage the retaining sleeve from the mandrel body, thus disengaging the lock sleeve.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

DETAILED DESCRIPTION OF A PREFERRED EMBODIMENT

Figure 1A:
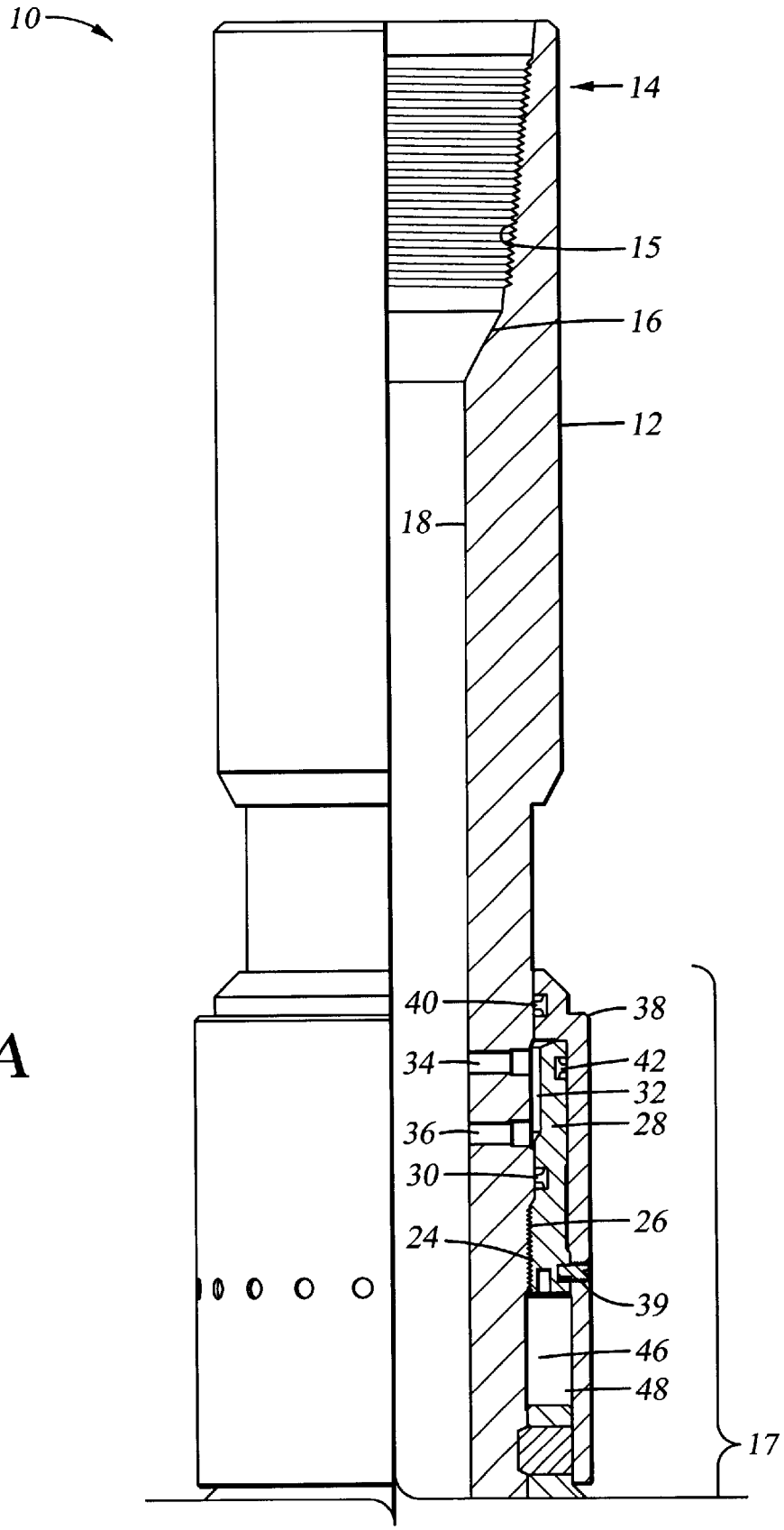
Fig. 1A (PRIOR ART)
FIGS. 1*a* and 1*b* are side views partially in section of a prior running tool design in a running-in position.
Figure 1B:
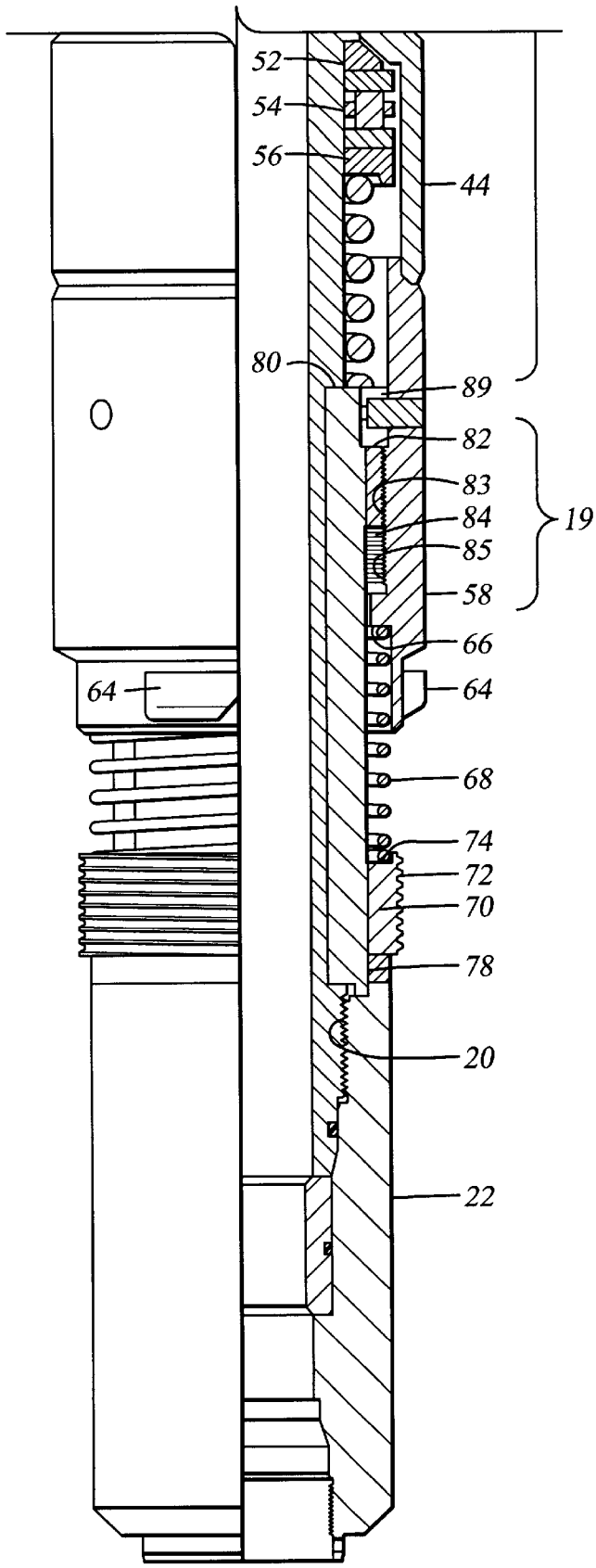
Fig. 1B (PRIOR ART)
Figure 2A:
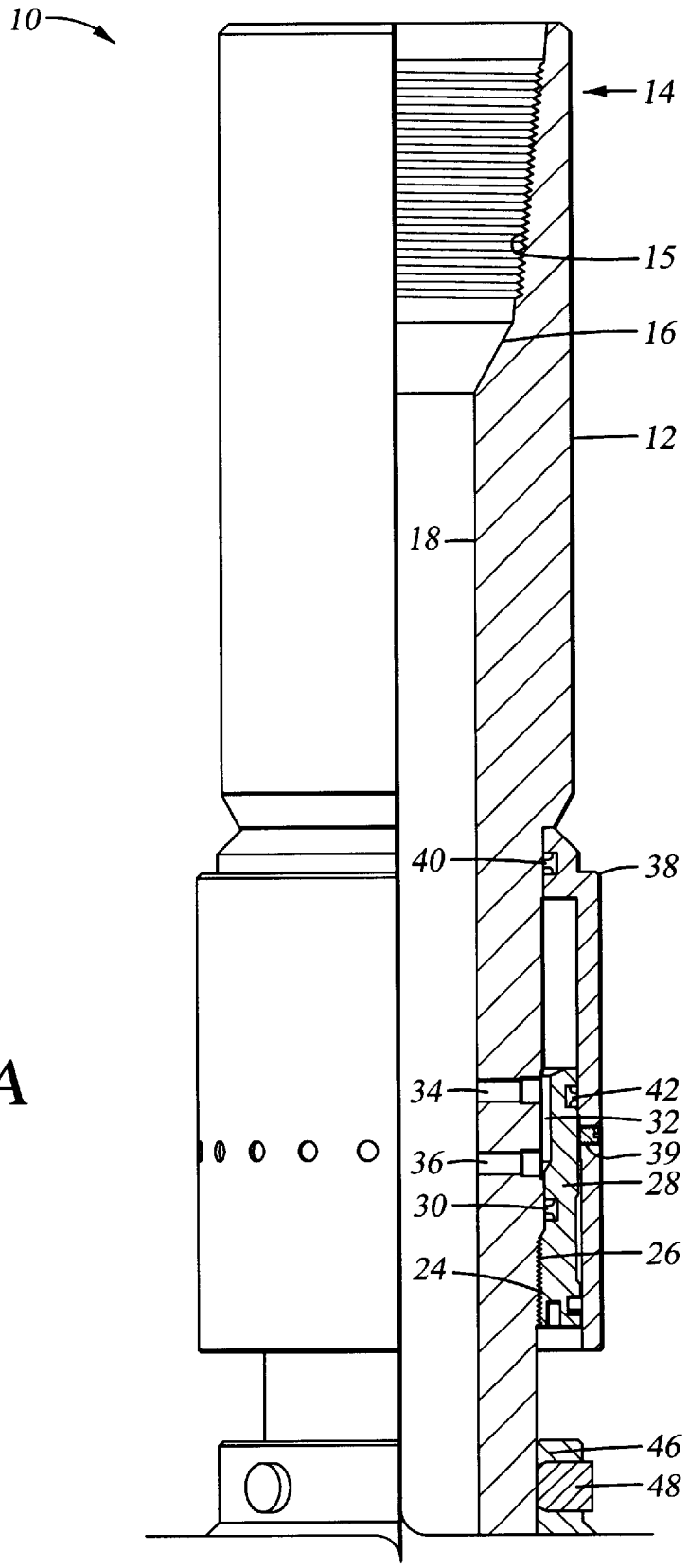
Fig. 2A (PRIOR ART)
FIGS. 2*a* and 2*b* are side views partially in section of a prior running tool design in a weight down position.
Figure 2B:
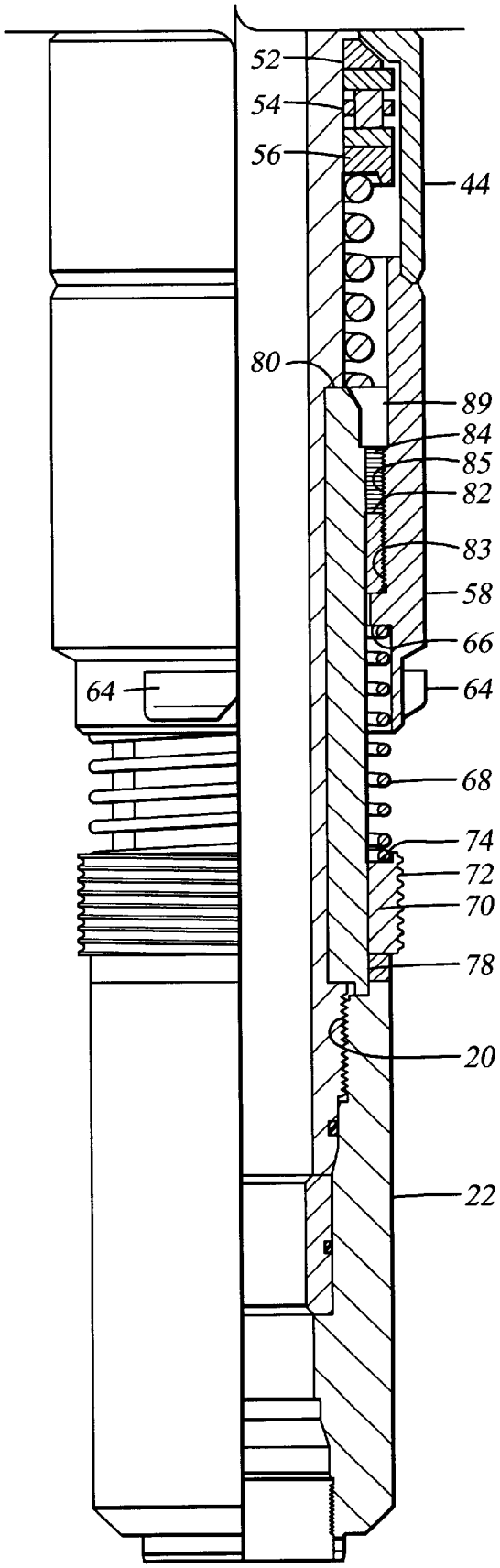
Fig. 2B (PRIOR ART)
Figure 3A:
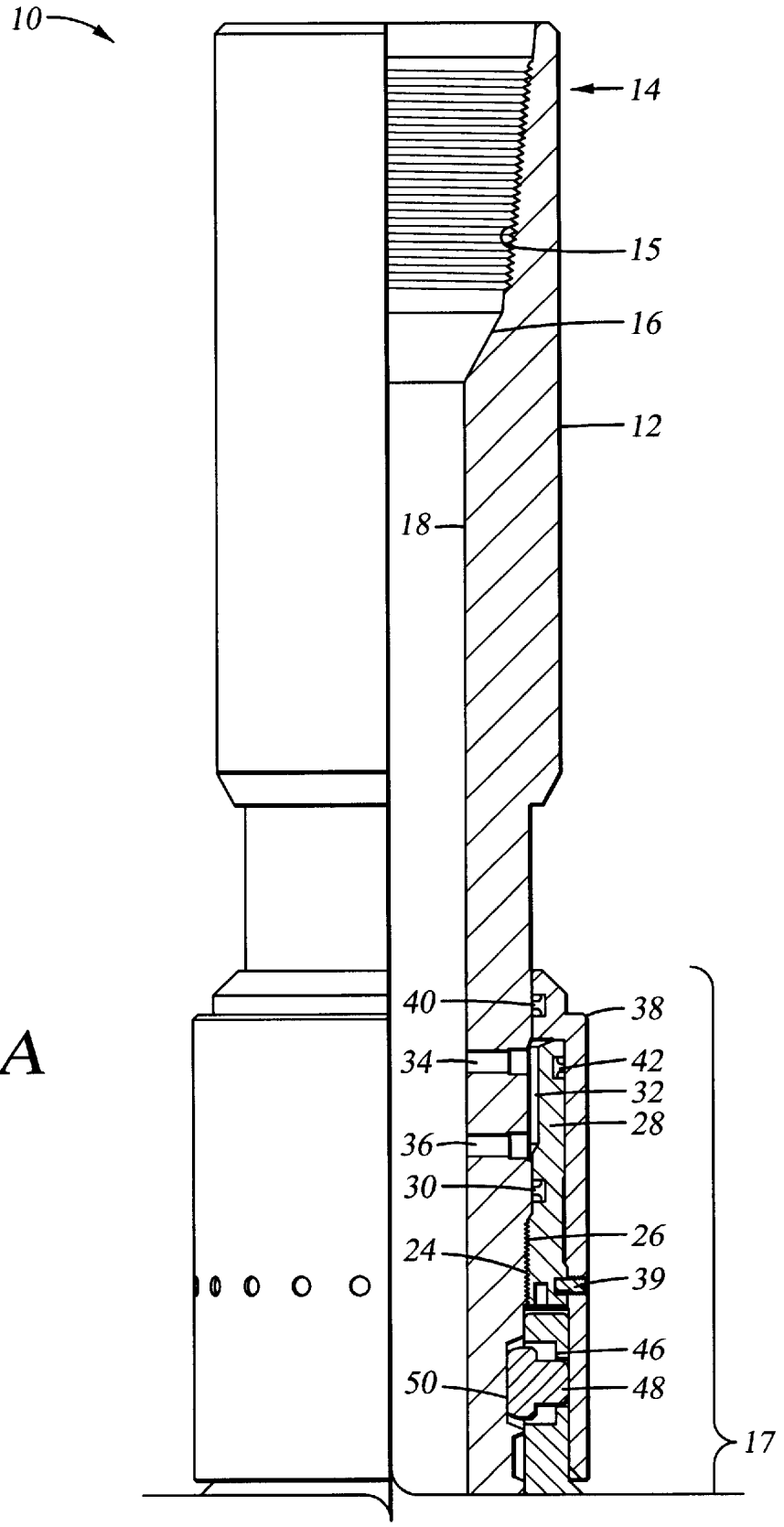
FIGS. 3*a* and 3*b* are side views partially in section of a running tool according to the invention in a running-in position.
Figure 3B:
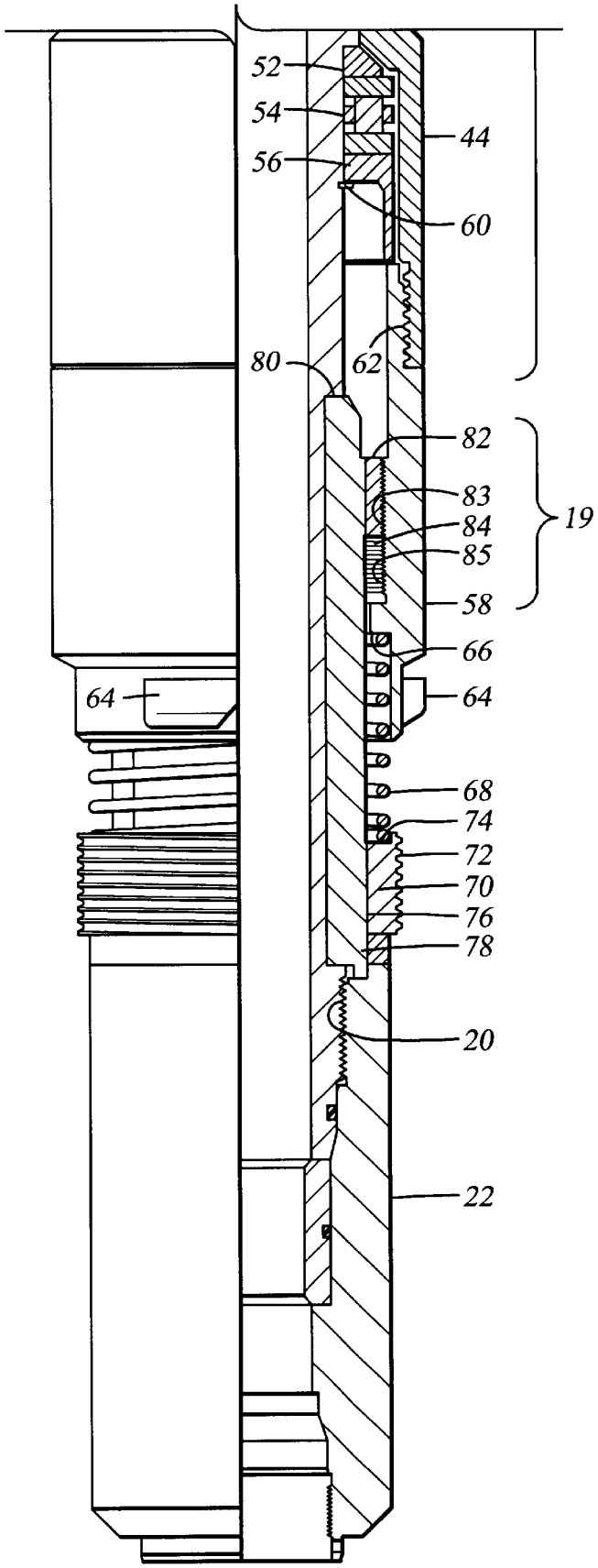
Figure 4A:
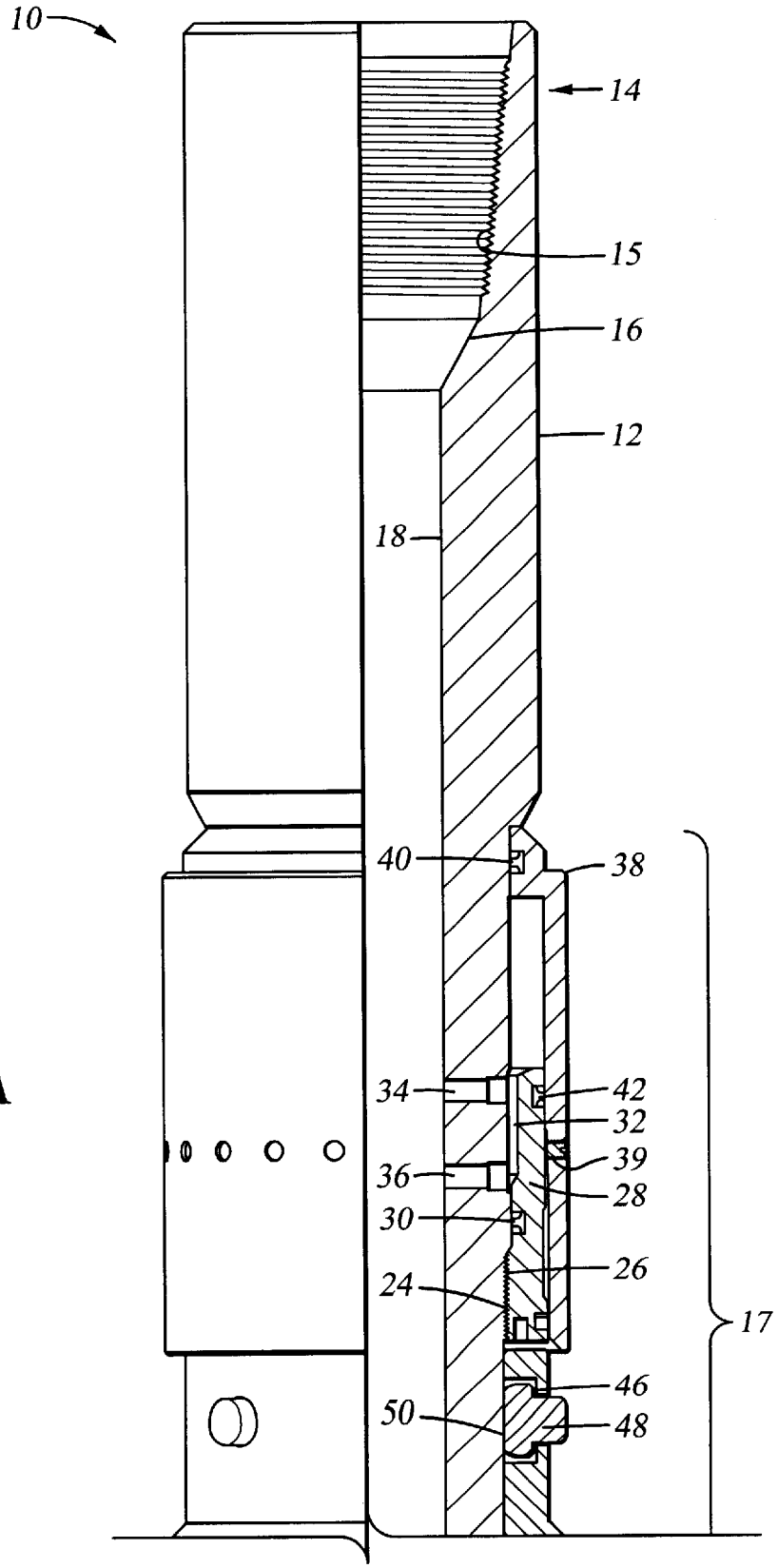
FIGS. 4*a* and 4*b* are side views partially in section of a running tool of the invention in a release position.
Figure 4B:
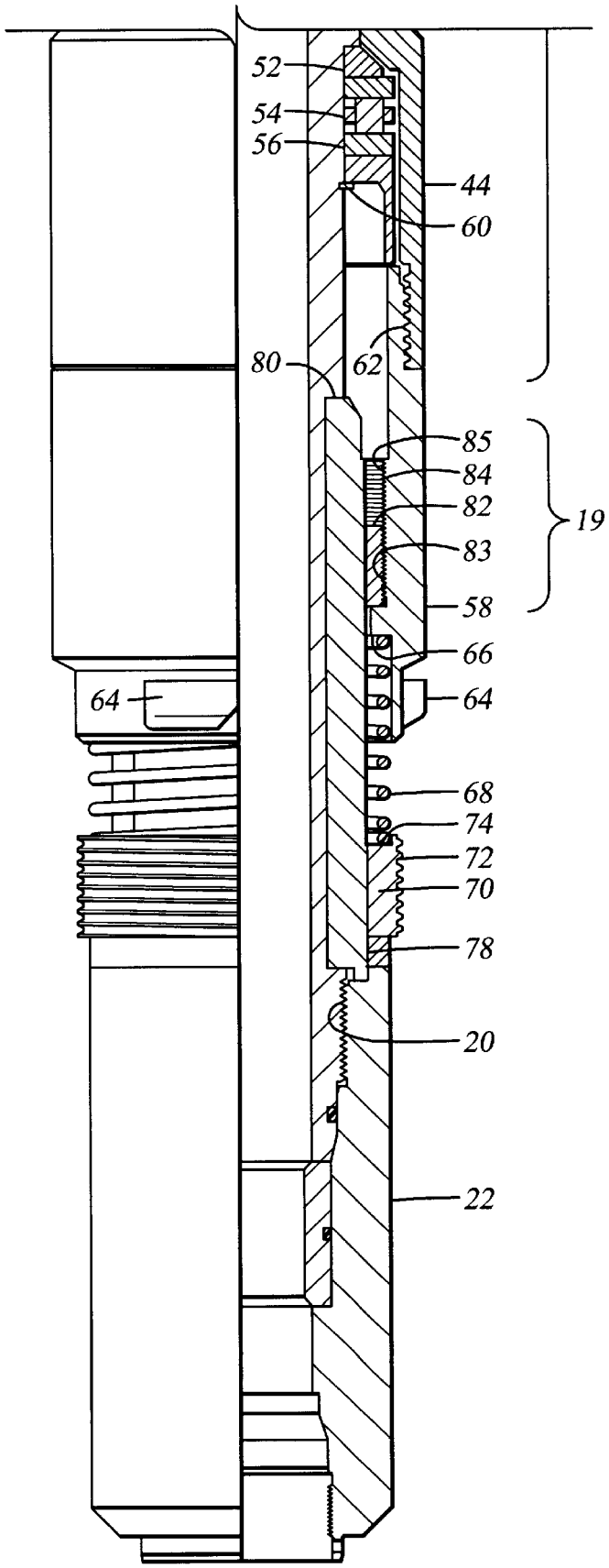
Figure 5A:
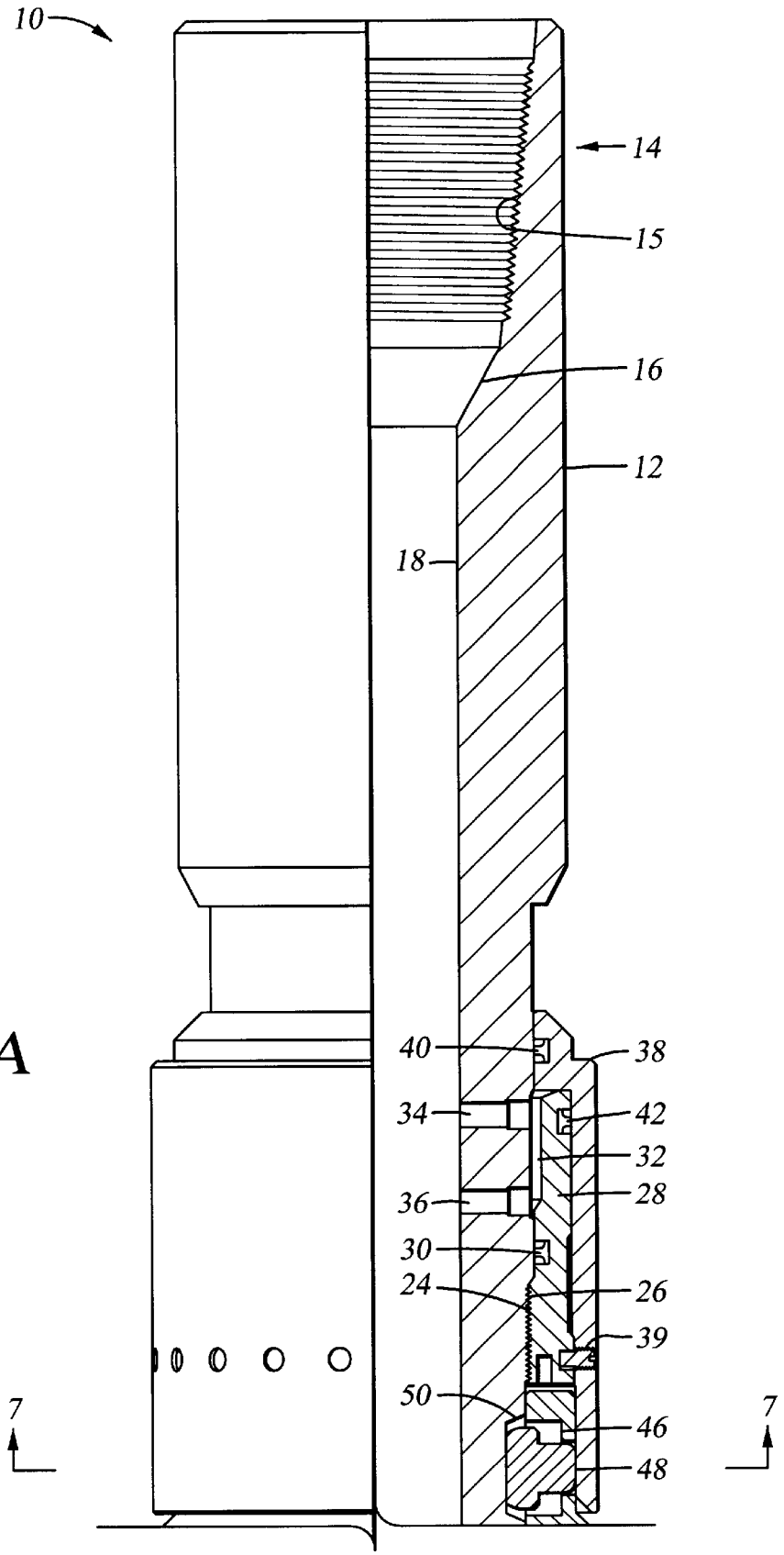
FIGS. 5*a* and 5*b* are side views partially in section of a running tool according to the invention in a running-in position.
Figure 5B:
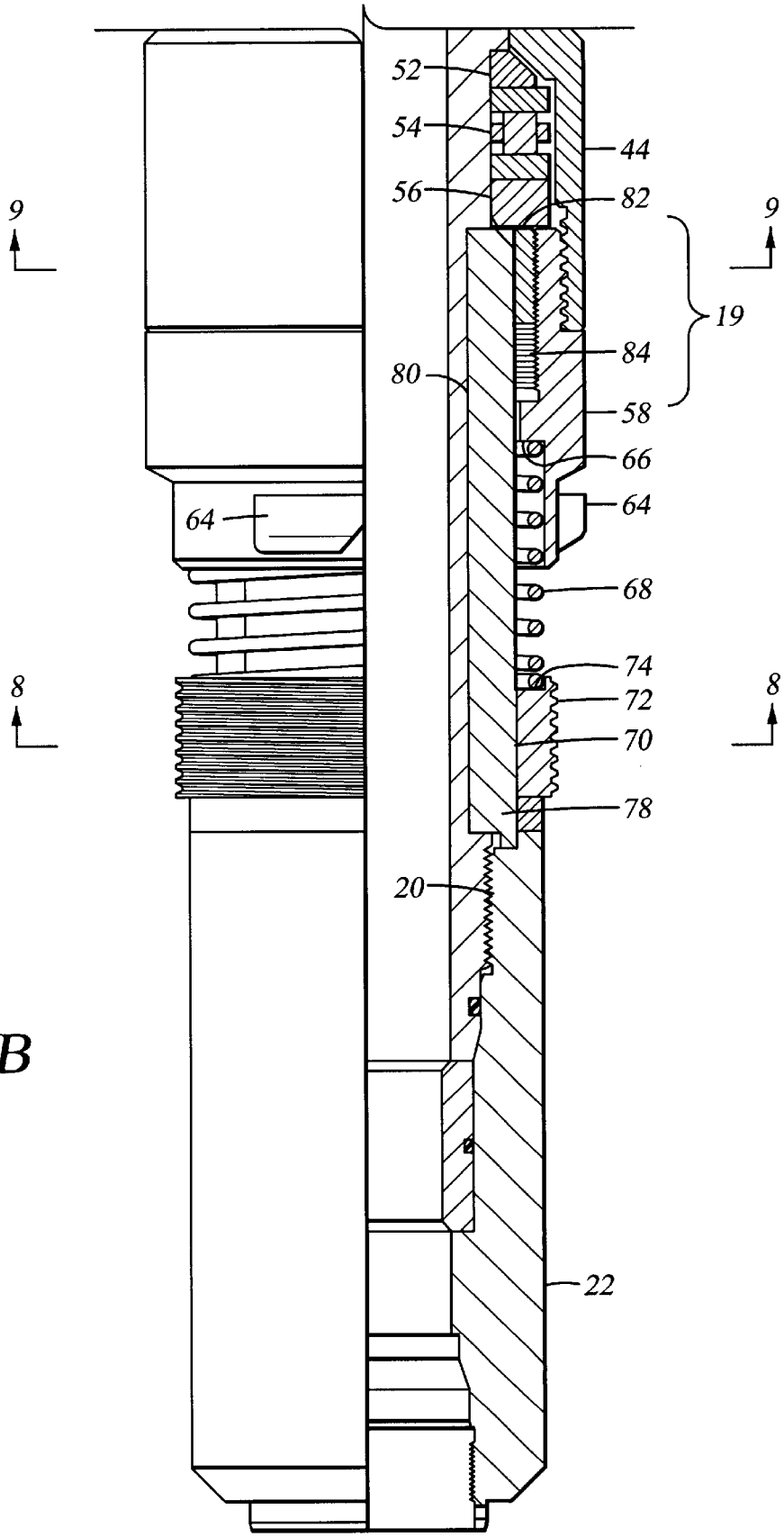
Figure 6A:
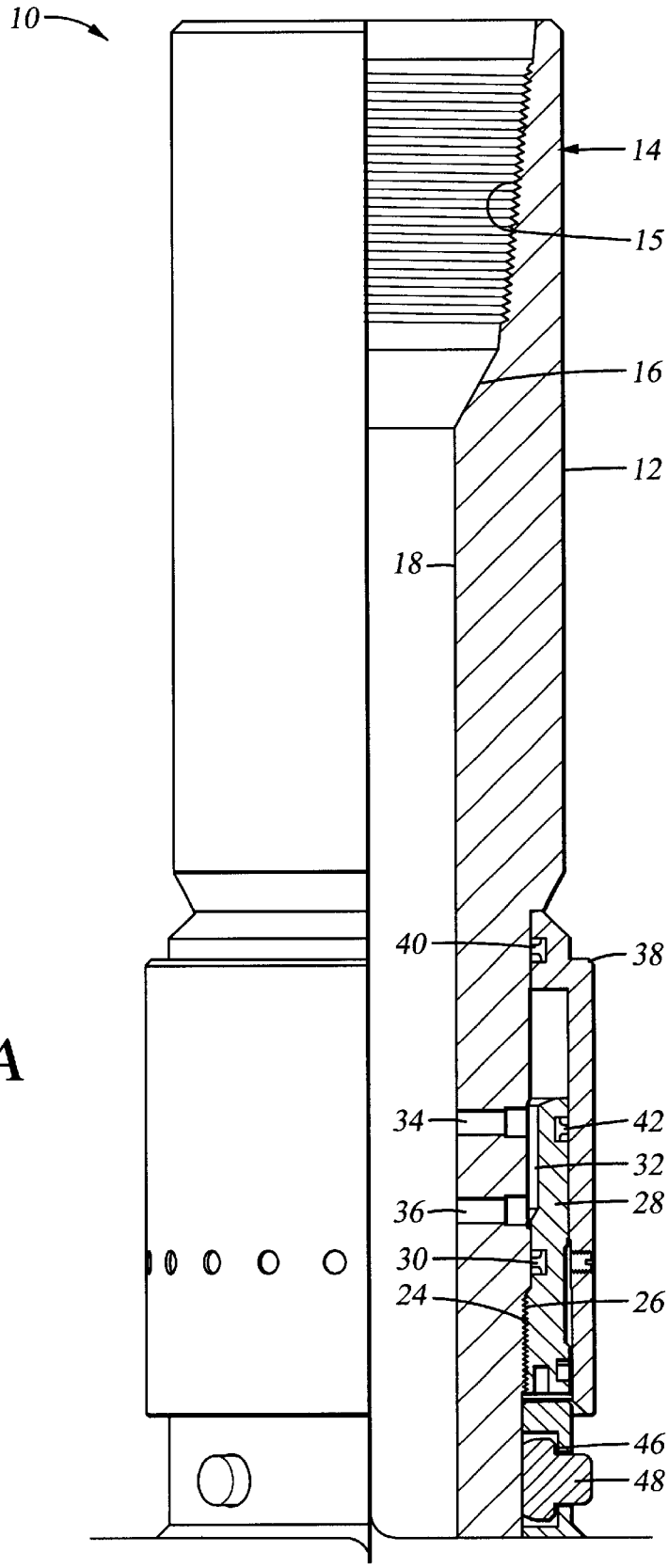
FIGS. 6*a* and 6*b* are side views partially in section of a running tool of the invention in a release position.
Figure 6B:
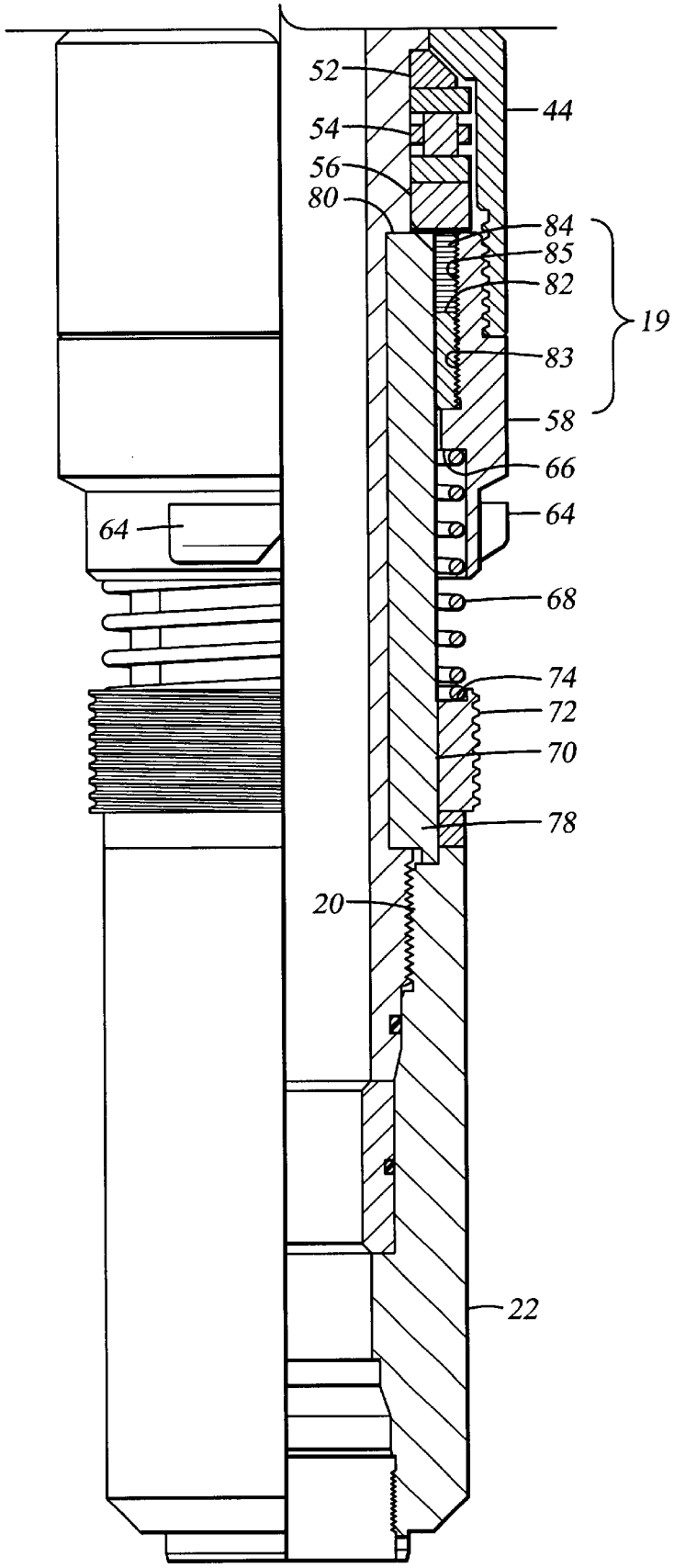

FIGS. 3*a* and 3*b* are side views in partial section of a running tool 10 according to one aspect of the invention in a running-in position adapted to be made up on a pipe string for releasably engaging a setting sleeve or liner hanger in a well bore. The invention generally includes a body 12 having a threaded connector 70, such as a float nut, disposed on its lower end and having an upper internally threaded portion 15 connectable to a pipe string (not shown). A latch assembly 17 is disposed on the body 12 to selectively transmit torque from the body 12 to at least a portion of the latch assembly 17. A lock assembly 19 is disposed at least partially between the latch assembly 17 and the body 12 to selectively transmit torque to a portion of the latch assembly when the lock assembly engages a portion of the latch assembly connected to a setting sleeve (not shown). The running tool 10 will now be described in more detail with reference to a preferred embodiment shown in FIGS. 3*a*, 3*b*, 4*a* and 4*b*. FIGS. 5*a*, 5*b*, 6*a* and 6*b* show an alternative embodiment of the invention which can be adapted to convert an existing running tool such as the tool shown in FIGS. 1*a*, 1*b*, 2*a* and 2*b* into a running tool of the invention. The description and numbering of FIGS. 5*a*, 5*b*, 6*a* and 6*b* is the same as FIGS. 3*a*, 3*b*, 4*a* and 4*b* and the description of the latter applies to the former.

The running tool includes a tubular mandrel body 12 having an upper end 14 which is internally threaded at the upper extent thereof for matingly engaging the external threads of the lower extent of the pipe string (not shown) running to the surface. The internally threaded upper extent 15 of the upper end of the mandrel 12 is connected through a tapered bore 16 to an internal bore 18 which runs through the remainder of the length of the mandrel body 12 to its lower end. The lower end of the mandrel body 12 has an externally threaded surface 20 adapted to be connected to a bottom sub assembly 22.

The mandrel body 12, near its upper end, has an externally threaded surface 24 which matingly engages the internally threaded surface 26 of a seal sub 28. A seal 30, such as an o-ring seal, a t-seal or other known seal, is disposed between the mandrel body 12 and the seal sub 28 at a location above the internal threaded portion 26 of the seal sub. The seal sub defines an annular channel or hydraulic chamber 32 at its upper end between the internal surface of the seal sub 28 and the mandrel body 12. A first port 34 and a second port 36 connect the annular channel or chamber 32 to the internal bore 18 running through the mandrel body 12 to enable a hydraulic fluid to be delivered into the annular channel or chamber 32 via internal bore 18.

An outer sleeve 38 is movably carried on the mandrel body and includes a seal 40 disposed at its upper end to form a sealing engagement between the mandrel body 12 and the outer sleeve 38. The outer sleeve 38 is sealingly disposed about the seal sub 28 between the inner diameter of the outer sleeve 38 and the mandrel body 12. The outer sleeve 38 is connected to the seal sub 28 via one or more shear screws 39. The seal sub 28 forms a sealing relationship between both the outer sleeve 38 via o-ring seal 42 and the mandrel body 12 to define the annular hydraulic chamber 32 at its upper end.

Figure 7:
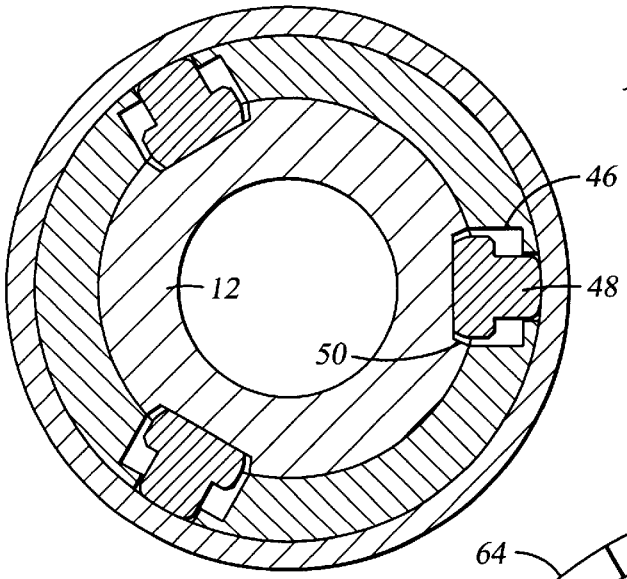
FIG. 7 is a cross sectional view of a running tool along line 7—7.

A lock sleeve 44 is carried on the mandrel body 12 and extends upwardly at least partially below the outer sleeve 38. One or more channels or chases 46, preferably milled slots, are provided in the upper end of the lock sleeve 44 about its circumference to receive one or more dogs 48 therein. The dogs 48 are seen more clearly in cross section in FIG. 7. Preferably, a plurality of channels 46 and dogs 48, for example six, are provided. The mandrel body 12 also defines one or more recesses 50 on its outer surface to receive the dogs 48 therein when received in the channels 46 in the lock sleeve 44. The dogs 48 are retained by the outer sleeve 38 when the latch assembly is engaged and has not been released. The lock sleeve 44 and, thus, the weight of the tool and drill string are carried on a spacer 52 which is supported on a thrust bearing 54. The thrust bearing 54 is carried by an annular bearing support 56 which is carried on the upper end of a thrusting cap 58 and is supported at its lower end on the mandrel body by a snap ring 60. The thrusting cap 58 is threadedly connected to the lock sleeve 44 on a threaded shoulder 62 formed around the upper end of the thrusting cap 58. The lower end of the thrusting cap 58 includes one or more latch keys 64 which are vertically received in mating slots (not shown) formed in the upper end of the setting sleeve or liner hanger. The latch keys 64 are used to transmit torque applied to the mandrel body 12 by the pipe string to the running tool or, if attached, to the liner hanger, except during release of the running tool 10 from the liner hanger. An inwardly disposed shoulder 66 on the thrusting cap 58 provides an upper stop for a coil spring 68 housed below the thrusting cap 58 and disposed around the mandrel body. The seal sub 28, the outer sleeve 38, the lock sleeve 44, dogs 48 and thrusting cap 58 comprise the latch assembly 17.

Figure 8:
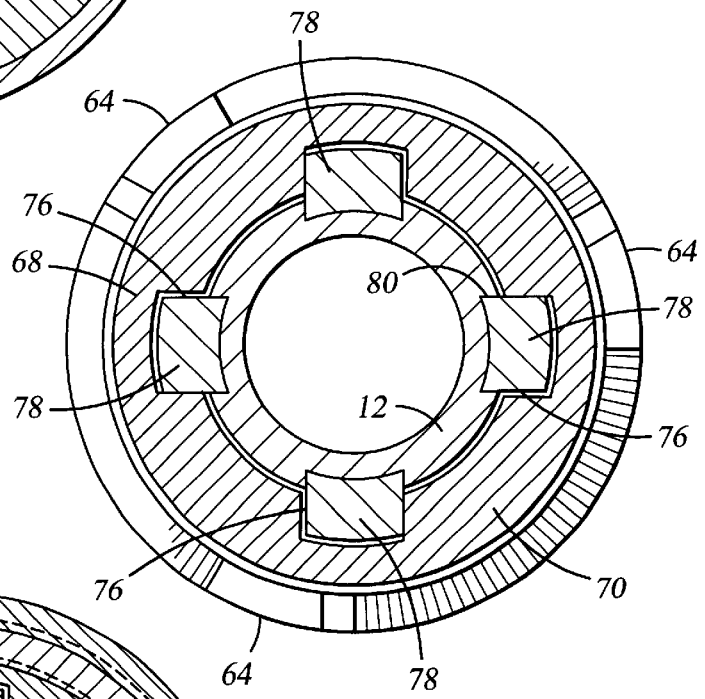
FIG. 8 is a cross sectional view of a running tool along line 8—8.

A float nut 70 is carried on the lower end of the mandrel body 12 and includes external threads 72 disposed on its outer surface. The external threads 72 are adapted to be received by the setting sleeve and are preferably left handed (or counter clockwise) threads. The upper surface 74 of the float nut 70 provides a lower support for the coil spring 68. The float nut 70 supports the spring between its upper surface 74 and the lower surface of the shoulder 66 of the thrusting cap 58. The float nut 70 defines four axial channels 76 which receive four splines 78 that fix the rotation of the float nut to the mandrel body while allowing vertical movement therealong. While four splines are preferred, any number could be used depending on the application. The splines 78 are also received at least partially in the mandrel body and prevent relative movement between the float nut 70 and the mandrel body 12 as shown in FIG. 8. FIG. 8 is a cross sectional view through the running tool at the location of the float nut 70 showing the relationship between the float nut 70, the mandrel body 12 and the splines 78. Four corresponding channels 80 are formed in the mandrel body 12 along the length of the mandrel body 12 at its lower end to receive the splines 78.

Figure 9:
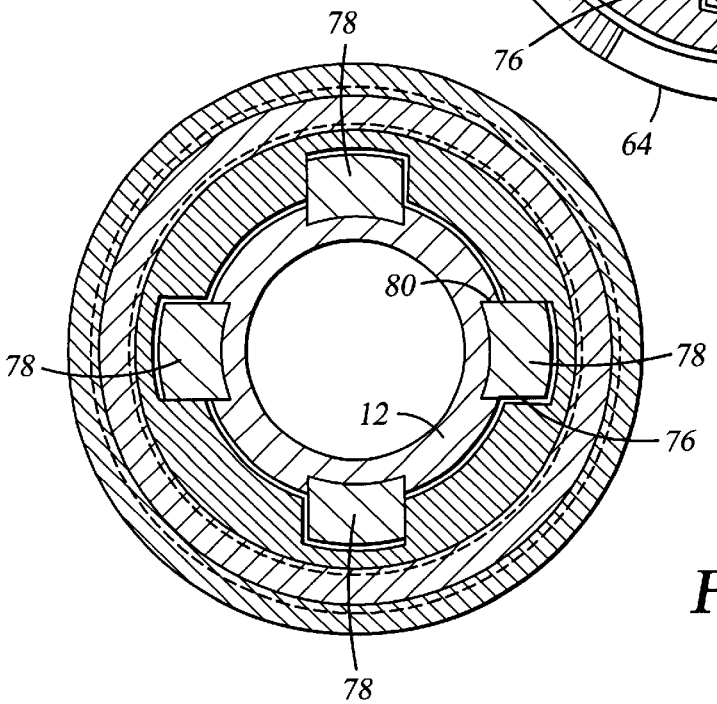
FIG. 9 is a cross sectional view of a running tool along line 9—9.

Referring again to FIGS. 3*a* and 3*b,* and the cross section of FIG. 9, a lock nut 82 is disposed between the thrusting cap 58 and the mandrel body 12 in an axial passageway 84 formed therebetween. The lock nut 82 is carried on the splines 78 to prevent relative rotational movement between the lock nut 82, the mandrel body 12 and the float nut 70. The outer surface 83 of the lock nut 82 is threaded and engages an inner threaded surface 85 of the thrusting cap 58. The outer threads on the lock nut 82 and internal surface of the thrusting cap 58 preferably have a finer pitch than the threads on the float nut 70 and the setting sleeve, are opposite in direction to those on the float nut 70 and are greater in number than those on the float nut 70. The difference in pitch enables greater vertical displacement of the float nut 70 compared to the lock nut 82 per rotation. The lock nut 82 travels down the internally threaded surface 85 of the thrusting cap on relative rotation between the mandrel body 12 and the thrusting cap 58. Thus, the float nut 70 can be disengaged from the liner hanger before the lock nut 82 bottoms out in the axial passageway 84 when it contacts the upper surface of the shoulder 66 on the thrusting cap 58. When this contact is made, the mandrel body 12 can again transmit torque to the thrusting cap 58 and to the setting sleeve and liner hanger if attached to the thrusting cap 58. The lock nut 82 and splines 78 comprise a lock assembly to transmit torque from the mandrel body 12 to the thrusting cap 58 when the lock nut moves into abutting relationship with thrusting cap 58.

The operation of the running tool will now be described in more detail in a right hand rotation run in application. While right hand rotation is preferred, left hand rotation could also be used. In operation, the running tool is made up and run into the well bore hole while maintaining right hand rotation on the pipe string. When the running tool and liner hanger have reached the desired depth, a hydraulic fluid is pumped into the bore of the pipe string or tubing string behind a plug, such as a ball, which could be disposed at the lower end of the liner supported below the setting sleeve. Hydraulic fluid flows from the bore in the drill pipe or tubing string and through the ports 34, 36 into the annular hydraulic chamber 32 as the pressure in the pipe string bore is increased. As the pressure in the hydraulic chamber 32 increases, the shear screw 39 securing the outer sleeve 38 to the seal sub 28 shears and the pressure in the annular chamber forces the outer sleeve 38 up the mandrel body 12. As the outer sleeve travels up the mandrel body, the dogs 48 disposed in the channels and recesses 46, 50 formed between the mandrel body and the lock sleeve 44 are released and move outwardly under the torque exerted through the mandrel body 12. Once the dogs 48 are released, the torque on the drill string is transmitted through the mandrel body 12 to the float nut 70 and the lock nut 82. Torque is not transmitted through the lock sleeve 44 and thrusting cap 58 once the dogs 48 are released until the lock nut 82 travels down the threaded surface of the thrusting cap 58 and bottoms out in the passageway 84 on the upper surface of the shoulder 66. On continued right hand rotation, the float nut 70 backs out of the setting sleeve or liner hanger to release the float nut 70 from the liner hanger. On further continued rotation, the lock nut 82 travels down the threaded surface of the thrusting cap 58 until the lock nut 82 bottoms out along the upper surface of the annular shoulder 66 of the thrusting cap 58. Once the lock nut bottoms out, the torque transmitted through the mandrel body 12 is again transmitted to the thrusting cap 58 to provide rotation to the liner hanger during subsequent procedures, such as cementing the liner in place in the well bore. On completion of the subsequent process, the running tool can be removed from the well bore on the end of the pipe string, leaving the liner in place.

Figure 10:
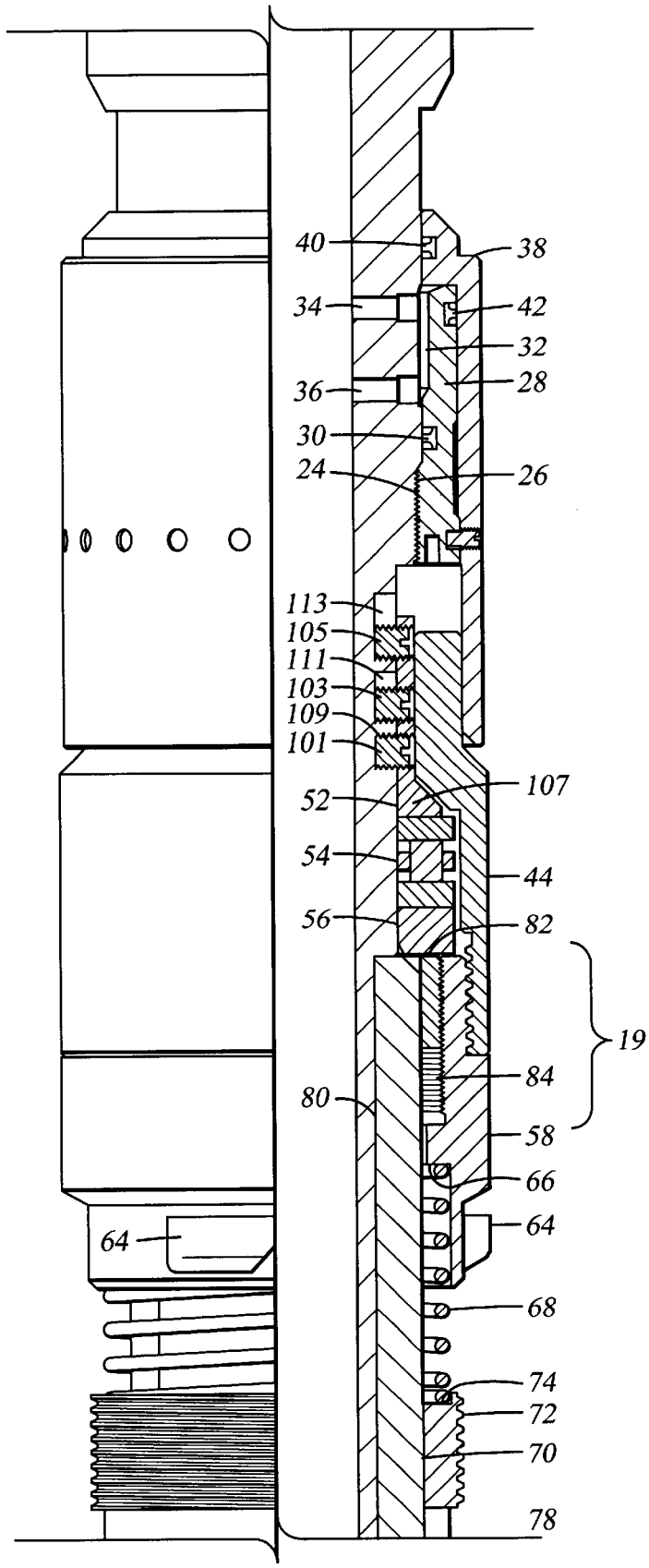
FIGS. 10 and 11 are side views partially in section of a running tool according to the invention.
Figure 11:
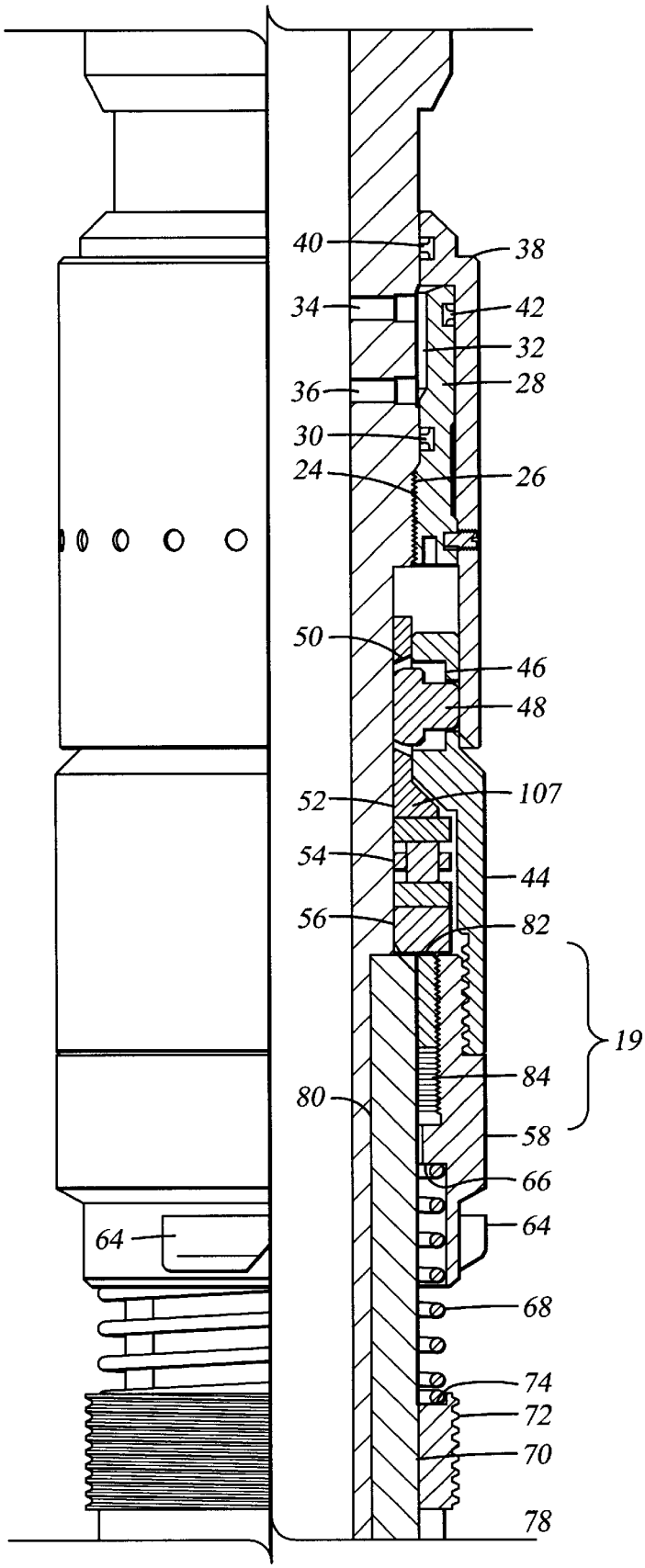

In another embodiment shown in FIGS. 10 and 11, a safety release can be provided which is mechanically operable without the assistance of hydraulic pressure. In this embodiment, one or more shear pins or set screws 101, 103, 105 (three shown in FIG. 10) are provided to connect an annular retaining sleeve 107 to the mandrel body. The recesses 50 which house the dogs 48 (shown in FIG. 11), formed as a part of the mandrel body 12 in embodiments described above, are disposed in the annular retaining sleeve 107. Preferably eighteen shear pins connect the annular retaining sleeve to the mandrel body. The retaining sleeve 107 rides on the thrust bearing 54. The shear pins 101, 103, 105 connect the retaining sleeve 107 to the mandrel body to prevent rotational and linear (axial) movement between the retaining sleeve and the mandrel body 12. On standard operation, hydraulic fluid is delivered as described above and the dogs are released as the outer sleeve moves up the mandrel body. However, should the inlets to the source of hydraulic fluid become clogged or should hydraulic fluid otherwise be prevented from operating the releasing mechanisms of the tool, a weight down position of the tool will shear the pins 101, 103, 105 and disengage retaining sleeve 107 from the mandrel body, and thus disengage the dogs 48 and the lock sleeve 44 from the mandrel body 12. In addition, a pre-determined right or left hand torque alone or in combination with a weight down position could be used to shear the pins connecting the annular retaining sleeve to the mandrel body.

Three channels 109, 111, 113 are formed in the mandrel body 12 to receive the shear pins 101, 103, 105. Preferably, the channels are sized and adapted to enable the pins to be sheared independently in sequence. When the dogs are held in the recesses 50, the lock sleeve 44 is rotationally locked to the retaining sleeve andthe mandrel body 12. After the device is set downhole, continued downward movement of the mandrel body causes relative vertical movement between the mandrel body and the retaining sleeve locked to the mandrel body by the shear pins and to the lock sleeve 44 by the dogs 48. In the embodiment shown, as the mandrel body continues downward movement relative to the lock sleeve 44, the lower pin 101 is sheared. As the mandrel body 12 continues downward under its weight, the second pin 103 moves in the second channel 111 until the second pin contacts the upper edge of the second channel 111. The second pin 103 is then sheared on continued movement of the mandrel body downward relative to the lock sleeve 44. On further movement of the mandrel body down hole, the third pin 105 contacts the upper edge of the third channel 113 and is sheared.

While the foregoing is directed to preferred embodiments of the present invention, other and further embodiments of the invention may be devised without departing from the basic scope thereof. The scope of the invention is determined by the claims which follow.

What is claimed is:

1. An apparatus sized and adapted for setting a liner in a well bore, comprising:

(a) a mandrel body having an upper end adapted to be connected in a pipe string and a lower end;

(b) a float nut carried on the mandrel body, the float nut having external connecting threads for engaging mating threads located on a setting sleeve;

(c) a latch assembly operably associated with the mandrel body and configured to restrict axial and rotational movement relative to the mandrel body before being disengaged; and (d) a locking member disposed between the latch assembly and the mandrel body and floating axially along a length of the mandrel body while being constrained against rotational movement relative to the mandrel body; wherein, upon application of torque to the mandrel body and without placing the apparatus in a weigh down position, the locking member is adapted to selectively transmit the torque between a portion of the latch assembly and the mandrel body after the latch assembly has been disengaged from the mandrel body.

2. The apparatus of claim 1 wherein the latch assembly is selectively connected to the mandrel body through one or more dogs.

3. The apparatus of claim 2 wherein the latch assembly further comprises a hydraulically operated lock sleeve assembly to release the dogs.

4. The apparatus of claim 2 wherein the lock sleeve assembly comprises:

a seal sub sealably connected to the mandrel body and an outer sleeve sealably disposed about the seal sub and the mandrel body and connected to the seal sub through one or more shear screws, and wherein the mandrel body, the seal sub and the outer sleeve define a chamber connected to a fluid source; and a lock sleeve containing the one or more dogs and disposed at least partially between the mandrel body and the outer sleeve.

5. The apparatus of claim 4, wherein the latch assembly further comprises a thrusting cap connected to the lock sleeve wherein the thrusting cap comprises one or more latch keys for selectively connecting to a setting sleeve.

6. The apparatus of claim 5, wherein the locking member comprises a lock nut having external threads thereon which are threadedly engaged to the thrusting cap to transmit torque on a selected amount of rotation.

7. The apparatus of claim 6, wherein the external threads of the lock nut are opposite in direction to the external threads on the float nut.

8. The apparatus of claim 7, wherein the external threads of the lock nut have a finer pitch than the external threads on the float nut.

9. The apparatus of claim 1, wherein selectively transmitting the torque comprises rotating the latch assembly and the mandrel body relative to one another to axially actuate the locking member from an initial position to a terminal position in which the locking member causes the latch assembly to be rotationally fixed relative to the mandrel body.

10. A setting tool for use in rotating a liner hanger prior to and subsequent to setting of a liner hanger, comprising:

(a) a mandrel body having an upper end adapted to connect to a pipe string and a lower end adapted to connect a liner hanger;

(b) a threaded member connected to the mandrel body and adapted to connect the mandrel body to the liner hanger;

(c) a hydraulically actuated latch assembly disposed about the mandrel body to constrain the mandrel body and the latch assembly from relative axial and rotational movement while the latch assembly is engaged;

(d) a mechanically actuated locking assembly disposed between the mandrel body and the latch assembly, wherein, without placing the tool in a weigh down postion, the mechanically actuated locking assembly allows a predetermined amount of rotation between the mandrel body and the latch assembly after the hydraulically actuated latch assembly is disengaged; and (e) a latch key member disposed on the mandrel body selectively engageable to the mandrel body through the latch assembly and the mechanically actuated locking assembly.

11. The setting tool of claim 10, wherein the latch key member comprises a thrusting cap.

12. The setting tool of claim 11, wherein the hydraulically actuated latch assembly comprises:

a seal sub connected to the mandrel body;

an outer sleeve disposed at least partially about the seal sub, the outer sleeve being selectively connected to the seal sub by a shear member, the seal sub, outer sleeve and mandrel body defining a chamber therebetween; and a lock sleeve rotatably connected to the mandrel body by one or more dogs disposed through the lock sleeve between the outer sleeve and the mandrel body, the lock sleeve being connected at its lower end to the thrusting cap.

13. The setting tool of claim 12, further comprising one or more ports connected to the chamber and to a bore in the mandrel body to enable fluid to flow through the mandrel body and into the chamber.

14. The setting tool of claim 13 wherein the lock sleeve is supported on a bearing carried on the mandrel body between the lock sleeve and the thrusting cap.

15. The setting tool of claim 14 wherein the lock assembly comprises a lock nut threadedly connected to the thrusting cap and rotatably connected to the mandrel body by one or more splines.

16. A setting tool for use in rotating a liner hanger prior to and subsequent to setting of the liner hanger in a well bore, comprising:

(a) a body defining a bore at least partially therethrough, the body having an upper internal threaded portion for connecting the body to a pipe string, an externally threaded member for connecting to a setting sleeve, a torque transmitting member to transmit torque from the body to a setting sleeve, the torque transmitting member being selectively rotatably connected to the body by a latch assembly, the latch assembly comprising:

a lock sleeve rotatably connected to the body by one or more dogs disposed at least partially therethrough and retained between the body;

an outer sleeve, the dogs being releasable on movement of the outer sleeve relative to the lock sleeve; and a lock member rotatably connected to the body and threadedly connected to the torque transmitting member, wherein the lock member is disposed in a passageway formed at least partially between the body and the torque transmitting member.

17. The setting tool of claim 16 wherein the lock assembly further comprises a seal sub rotatably and sealably connected to the body and sealably disposed between the outer sleeve and the body; the seal sub, outer sleeve and body forming a fluid chamber therebetween having fluid communication to the bore in the body through one or more ports.

18. The setting tool of claim 17, wherein the torque transmitting member is connected to the lock sleeve and the lock member.

19. The setting tool of claim 18 wherein the lock sleeve is carried on a bearing assembly carried on the body.

20. The setting tool of claim 19 further comprising a retaining ring connected to the mandrel body and defining one or more recesses into which one or more dogs can be disposed.

21. The setting tool of claim 20 wherein the retaining ring is connected to the mandrel body by one or more shear pins.

22. The setting tool of claim 21 wherein the mandrel body defines two or more channels which receive a shear pin therein and are sized and adapted to enable independent shear of each shear pin.

23. The setting tool of claim 22 wherein the retaining ring is disposed adjacent a bearing.

24. The setting tool of claim 23 wherein the latch assembly further comprises a lock sleeve connected to the mandrel.

25. A running tool, comprising:

(a) a mandrel body having an upper end adapted to be connected in a pipe string and a lower end;

(b) a latch assembly configured to restrict axial and rotational movement relative to the mandrel body while engaged, the latch assembly comprising:

a dog disposed in a recess formed in the mandrel body while the latch assembly is engaged so that the dog is constrained against axial and rotational movement;

a lock sleeve disposed about the mandrel body and having an opening to receive the dog so that the lock sleeve is constrained against axial and rotational movement while the dog is locked in the recess; and an outer sleeve disposed about the mandrel body and adapted to retain the dog in the recess when the latch assembly is engaged; and (c) a locking member disposed between the latch assembly and the mandrel body and floating along a length of the mandrel body while being constrained against rotational movement relative to the mandrel body; wherein, upon application of torque to the mandrel body and without placing the tool in a weight down position, the locking member is adapted to allow a predetermined amount of rotation between the latch assembly and the mandrel body after the latch assembly has been disengaged from the mandrel body.

26. The running tool of claim 25, further comprising an externally threaded member carried on the mandrel body for engaging mating threads located on a down hole tool.

27. The running tool of claim 25, wherein, while the latch assembly is engaged, the locking member is secured against relative rotation with the mandrel body only by the dog.

28. The running tool of claim 25, wherein the latch assembly is not constrained from relative rotation with the mandrel body by a clutch assembly disengagable in a weight down position.

29. The running tool of claim 25, wherein the latch assembly includes a port formed therein to allow a fluid into a chamber defined at least partially by the latch assembly and wherein the fluid produces a pressure to disengage the latch assembly.

30. The running tool of claim 25, wherein the locking member includes threads engaged with a threaded surface formed on a surface of the latch assembly.

31. The running tool of claim 25, wherein the latch assembly forms a surface disposed to limit axial travel of the locking member, wherein, upon contacting the surface, the locking member constrains the latch assembly against relative rotation with the mandrel body.

32. A running tool, comprising:

(a) a mandrel body having an upper end adapted to be connected in a pipe string and a lower end;

(b) a hydraulically-actuated latch assembly disposed on the mandrel body and comprising a locking mechanism positionable in a locked position, in which the latch assembly is constrained against rotation relative to the mandrel body, and an unlocked position, in which the latch assembly is free to rotate relative to the mandrel body without placing the tool in weight down position; and (c) a locking member disposed between the latch assembly and the mandrel body, wherein the locking member is actuated by the latch assembly from an initial position to a terminal position in which the locking member constrains the latch assembly from rotation relative to the mandrel body.

33. The running tool of claim 32, wherein the locking mechanism comprises a dog selectively disposable in a recess formed in the mandrel body and wherein the latch assembly comprises:

a first sleeve defining a coupling for a down hole tool and forming holes to receive the dog; and a second sleeve slidably disposed relative to the mandrel body to selectively retain the dog.

34. The running tool of claim 32, wherein the locking member includes threads engaged with a threaded surface formed on a surface of the latch assembly.

35. The running tool of claim 32, wherein the latch assembly forms a surface disposed to limit axial travel of the locking member, wherein, upon contacting the surface, the locking member constrains the latch assembly against relative rotation with the mandrel body.

36. The running tool of claim 35, wherein the lock member is axially slidingly disposed on a key disposed on the mandrel body.

* * * * *